US009694886B2

(12) United States Patent
Kwun et al.

(10) Patent No.: US 9,694,886 B2
(45) Date of Patent: Jul. 4, 2017

(54) VARIABLE-PITCH-PROPELLER DRIVE DEVICE AND PITCH-ANGLE CONTROL METHOD, AND BOAT HAVING SAME

(71) Applicant: SAMSUNG HEAVY IND. CO., LTD., Seoul (KR)

(72) Inventors: Hyuk Kwun, Geoje-si (KR); Ji-Nam Kim, Tongyeong-si (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 462 days.

(21) Appl. No.: 14/375,694

(22) PCT Filed: Dec. 27, 2012

(86) PCT No.: PCT/KR2012/011597
§ 371 (c)(1),
(2) Date: Jul. 30, 2014

(87) PCT Pub. No.: WO2013/115487
PCT Pub. Date: Aug. 8, 2013

(65) Prior Publication Data

US 2015/0166157 A1 Jun. 18, 2015

(30) Foreign Application Priority Data

Jan. 31, 2012 (KR) ..... 10-2012-0009755

(51) Int. Cl.
*B63H 3/04* (2006.01)
*B63H 3/00* (2006.01)
*B63H 3/10* (2006.01)

(52) U.S. Cl.
CPC ..... *B63H 3/008* (2013.01); *B63H 3/002* (2013.01); *B63H 3/04* (2013.01); *B63H 3/10* (2013.01)

(58) Field of Classification Search
CPC . B63H 3/008; B63H 3/04; B63H 3/10; B63H 3/002; F04D 29/36; F04D 29/362
See application file for complete search history.

(56) References Cited

U.S. PATENT DOCUMENTS 675,563 A * 6/1901 Johnston ..... B63H 3/04 416/161
2,593,290 A * 4/1952 Gansert ..... B63H 3/04 416/161

(Continued)

FOREIGN PATENT DOCUMENTS

EP 0595420 A1 5/1994
JP 40-10902 6/1965

(Continued)

OTHER PUBLICATIONS

Office Action dated Jun. 2, 2015 for Japanese Patent Application No. 2014-555476 and its English summary provided by Applicant's foreign counsel.

(Continued)

*Primary Examiner* — Craig Kim
*Assistant Examiner* — Eldon Brockman
(74) *Attorney, Agent, or Firm* — Ladas & Parry, LLP

(57) ABSTRACT

Provided is a driving apparatus of a variable pitch propeller having blades, each of which has a pitch angle changed in a rotational direction of a propeller shaft, and a pitch adjuster for adjusting the pitch angle. The pitch adjuster includes blade actuating shafts that are connected to eccentric stubs coupled to lower ends of the blades and are disposed inside the propeller shaft so as to allow linear reciprocation and to push or pull the eccentric stubs, and a power converter that converts a rotating motion of the propeller shaft into a linearly reciprocating motion of the blade actuating shafts.

13 Claims, 9 Drawing Sheets

(56) References Cited

U.S. PATENT DOCUMENTS

| | | | | |
|---|---|---|---|---|
| 2,969,118 | A * | 1/1961 | Allen, Jr. | B64C 11/40 416/154 |
| 3,295,610 | A | 1/1967 | Frias | |
| 3,310,118 | A * | 3/1967 | Smith | B63H 3/04 416/166 |
| 3,853,427 | A * | 12/1974 | Holt | B63H 3/04 416/167 |
| 4,540,341 | A | 9/1985 | Wührer | |
| 5,028,210 | A | 7/1991 | Peterson et al. | |
| 5,129,785 | A * | 7/1992 | Speer | B63H 3/04 416/147 |
| 5,464,324 | A * | 11/1995 | Langenberg | B63H 3/04 416/127 |
| 8,465,257 | B1 * | 6/2013 | Noble | B63H 3/008 416/167 |
| 8,951,018 | B1 * | 2/2015 | Calamia | B63H 3/04 416/228 |
| 2008/0166933 | A1 | 7/2008 | Rosenkranz | |

FOREIGN PATENT DOCUMENTS

| | | |
|---|---|---|
| JP | 54-74497 U | 5/1979 |
| JP | 62-43394 | 2/1987 |
| JP | 62-43395 A | 2/1987 |
| KR | 10-2012-0026692 | 3/2012 |

OTHER PUBLICATIONS

International Search Report for PCT/KR2012/011597 mailed on Apr. 16, 2013 and its translation thereof.

Extended European Search Report dated Nov. 13, 2015 for European Patent Application No. 12867702.8.

International Preliminary Report on Patentability (Chapter II) for PCT/KR2012/011597 of May 20, 2014 and its English translation from WIPO.

Written Opinion of the International Search Authority for PCT/KR2012/011597 mailed on Apr. 16, 2013 and its English machine translation by Google Translate.

* cited by examiner

VARIABLE-PITCH-PROPELLER DRIVE DEVICE AND PITCH-ANGLE CONTROL METHOD, AND BOAT HAVING SAME

CROSS-REFERENCE TO RELATED APPLICATIONS

This application is the U.S. National Stage of International Patent Application No. PCT/KR2012/011597 filed on Dec. 27, 2012, which claims priority to Korean Patent Application No. 10-2012-0009755 filed on Jan. 31, 2012, the disclosures of which are hereby incorporated by reference in their entireties.

TECHNICAL FIELD

The present invention relates to a driving apparatus of a variable pitch propeller whose blades are subjected to a change in pitch depending on a speed at which a fluid is introduced toward the propeller, a pitch angle control method of the variable pitch propeller, and a ship having the driving apparatus.

BACKGROUND ART

In ships, propulsion systems generate a propulsive force for navigation. One of the propulsion systems is a variable pitch propeller having numerous blades each having a variable pitch in consideration of navigation conditions of the ship.

However, such a variable pitch propeller is designed such that all of the numerous blades are changed in pitch at the same angle, and does not easily maximize propulsion efficiency.

In other words, a speed at which a fluid is introduced toward the variable pitch propeller located at the stern of the ship is not uniform. Nevertheless, a pitch set based on an average fluid speed is equally applied in all the variable pitch propellers. Thus, a region in which the blade pitch is greater in comparison with the speed at which the fluid is introduced undergoes a cavitation phenomenon, which is mainly responsible for hull vibrations and rudder wear.

DISCLOSURE

Technical Problem

The present embodiment provides a driving apparatus of a variable pitch propeller, a pitch angle control method of the variable pitch propeller, and a ship having the driving apparatus, capable of stably changing a pitch of each blade depending on a change in a speed at which a fluid is introduced toward the variable pitch propeller.

Technical Solution

According to an aspect of the present invention, there is provided a driving apparatus of a variable pitch propeller having blades, each of which has a pitch angle changed in a rotational direction of a propeller shaft, and a pitch adjuster for adjusting the pitch angle, wherein the pitch adjuster includes: blade actuating shafts that are connected to eccentric stubs coupled to lower ends of the blades and are disposed inside the propeller shaft so as to allow linear reciprocation and to push or pull the eccentric stubs; and a power converter that converts a rotating motion of the propeller shaft into a linearly reciprocating motion of the blade actuating shafts.

Here, the power converter may include: guide pins that extend from outer circumferential surfaces of the blade actuating shafts and protrude through guide slots formed in an outer surface of the propeller shaft; and a guide ring that encloses an outer circumference of the propeller shaft and has a pitch deciding groove which is formed in an inner surface thereof and along which the guide pins slide.

Further, the guide slots may be cut out in an axial direction of the propeller shaft.

Further, the driving apparatus may further include a guide plate which is disposed inside the propeller shaft and through which the blade actuating shafts pass to be slidably supported for stable movement of the blade actuating shafts.

Further, the guide plate may include through-holes through which the blade actuating shafts pass and each of which is in a tapered shape.

Further, the guide slots may extend in an axial direction of the propeller shaft, and the guide pins may reciprocate in the guide slots while being rotated along with the propeller shaft to slide along the pitch deciding groove.

Also, the pitch angle may be changed depending on a speed at which a fluid is introduced in front of each blade.

Further, the propeller shaft may be installed to extend through a stem boss of a hull, and the pitch angle of the blade located at an uppermost end of the propeller shaft may be relatively smaller than that of the blade located at a lowermost end of the propeller shaft.

Further, the pitch angle of the blade may be gradually increased from the uppermost end to the lowermost end according to a rotational angle of the propeller shaft.

Further, the blades may be disposed apart along a circumference of a hub coupled to an end of the propeller shaft, and the blade actuating shafts may be connected to the respective blades, individually adjust the pitch angles of the blades, and include guide pins moving along the pitch deciding groove.

Further, the pitch deciding groove may be shaped of a closed loop recessed along a circumferential direction of the guide ring, and be disposed to be inclined at a predetermined angle with respect to a radial direction of the propeller shaft.

Also, the pitch deciding groove may include a first position defining a first pitch angle of the blade when the blade is located at an uppermost end of the propeller shaft, and a second position defining a second pitch angle of the blade when the blade is located at a lowermost end of the propeller shaft. The first pitch angle may be a minimum pitch angle, and the second pitch angle may be a maximum pitch angle.

Further, each of the blade actuating shafts may include a first portion connected to each of the eccentric stubs, and a second portion supported by the guide plate, and the first and second portions are interconnected by a rotary joint.

According to another aspect of the present invention, there is provided a pitch angle control method of a variable pitch propeller coupled to a propeller shaft to generate a propulsive force. The pitch angle control method includes: determining a speed at which a fluid is introduced toward blades to decide a first pitch angle of the blade at a point at which the speed at which the fluid is introduced is minimum and a second pitch angle of the blade at a point at which the speed at which the fluid is introduced is maximum; and controlling the pitch angles of the blades so as to be gradually increased or decreased between the first and second pitch angles according to a rotational direction of the propeller shaft.

Advantageous Effects

In the driving apparatus of the variable pitch propeller of the present embodiment, since the pitches of blades are changed corresponding to a speed at which a fluid is introduced toward the variable pitch propeller, propulsive efficiency is improved.

Further, the variable pitch propeller of the present embodiment can be stably controlled when the pitches are changed.

MODE FOR INVENTION

Hereinafter, an exemplary embodiment of the invention will be described in greater detail with reference to the accompanying drawings. First, this applicant has already proposed a variable pitch propeller for adjusting a blade pitch in view of a speed at which a fluid is introduced toward the propeller in Korean Patent Application No. 10-2010-0088719, the entire contents of which are incorporated by reference herein.

Figure 1:
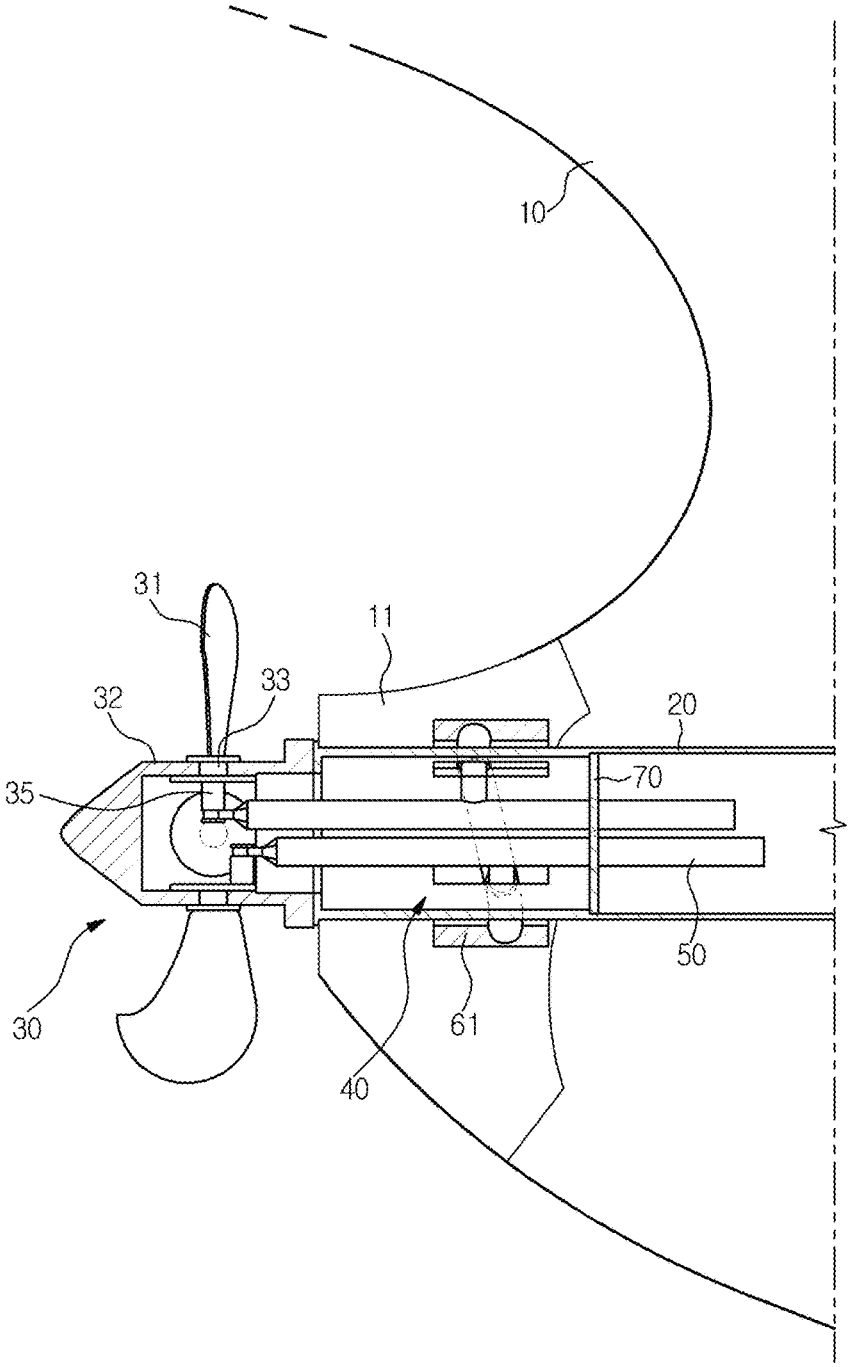
FIG. 1 schematically illustrates a hull stem on which a variable pitch propeller of an embodiment of the present invention is installed.

Referring to FIG. 1, a propulsion system of a ship according to an embodiment is installed on an end of a hollow propeller shaft 20 passing through a stern boss 11 of a hull 10, and includes a variable pitch propeller 30 generating a propulsive force while blades 31 undergo a change in pitch.

This variable pitch propeller 30 has a pitch adjuster 40 for adjusting a pitch angle of each blade 31 so as to continuously change the pitch angle of each blade 31 depending on a rotational angle of the propeller shaft 20 during the rotation of the propeller shaft 20.

The pitch adjuster 40 is provided to be able to individually adjust the pitch angles of the numerous blades 31 that are coupled to an outer surface of a hub 32 of the variable pitch propeller 30 so as to be rotatable around an axis.

Each of the numerous blades 31 is provided with a disc-shaped rotary plate 33 that is rotatably coupled to the outer surface of the hub 32, and an eccentric stub 35 that is disposed under the rotary plate 33 away from the center of the rotary plate 33.

The rotary plate 33 is installed on the hub 32 so as to be rotatable in a circumferential direction while maintaining a waterproof state. The eccentric stub 35 is pushed or pulled to rotate the rotary plate 33 by the pitch adjuster 40.

Figure 2:
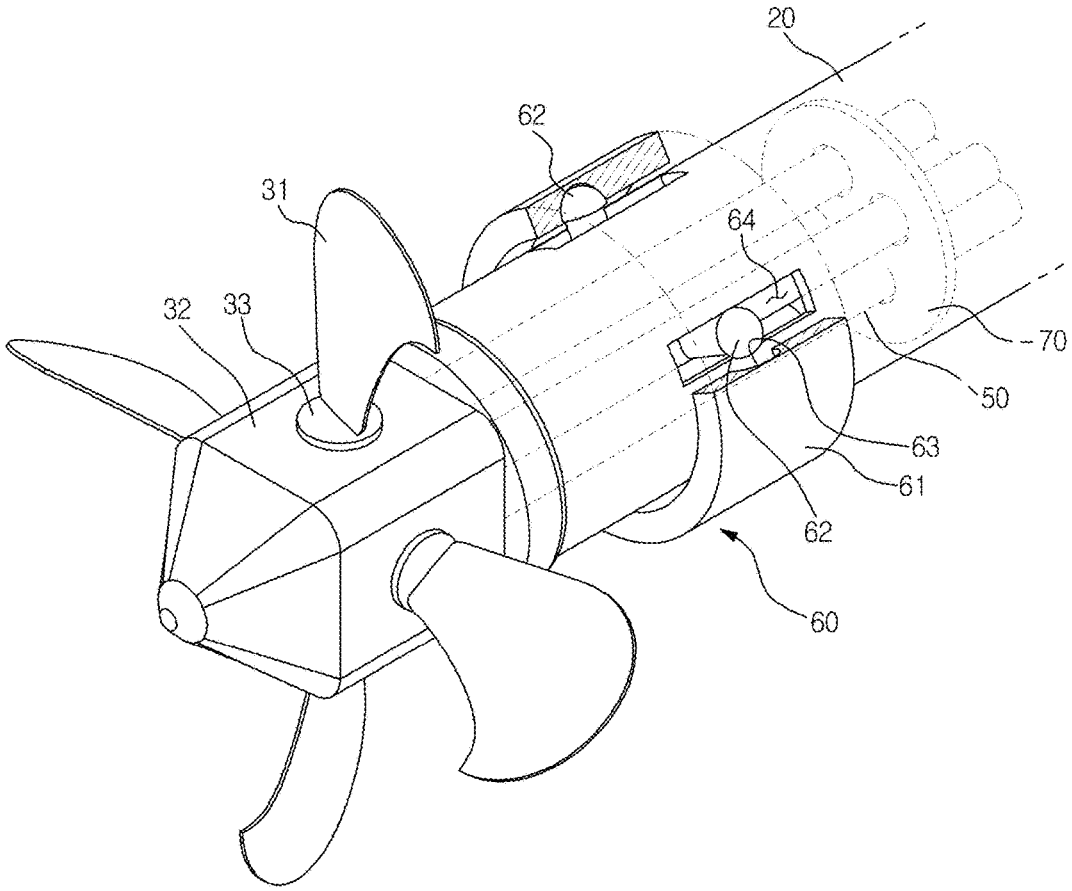
FIG. 2 illustrates the variable pitch propeller coupled with a pitch adjuster of the embodiment of the present invention.
Figure 3:
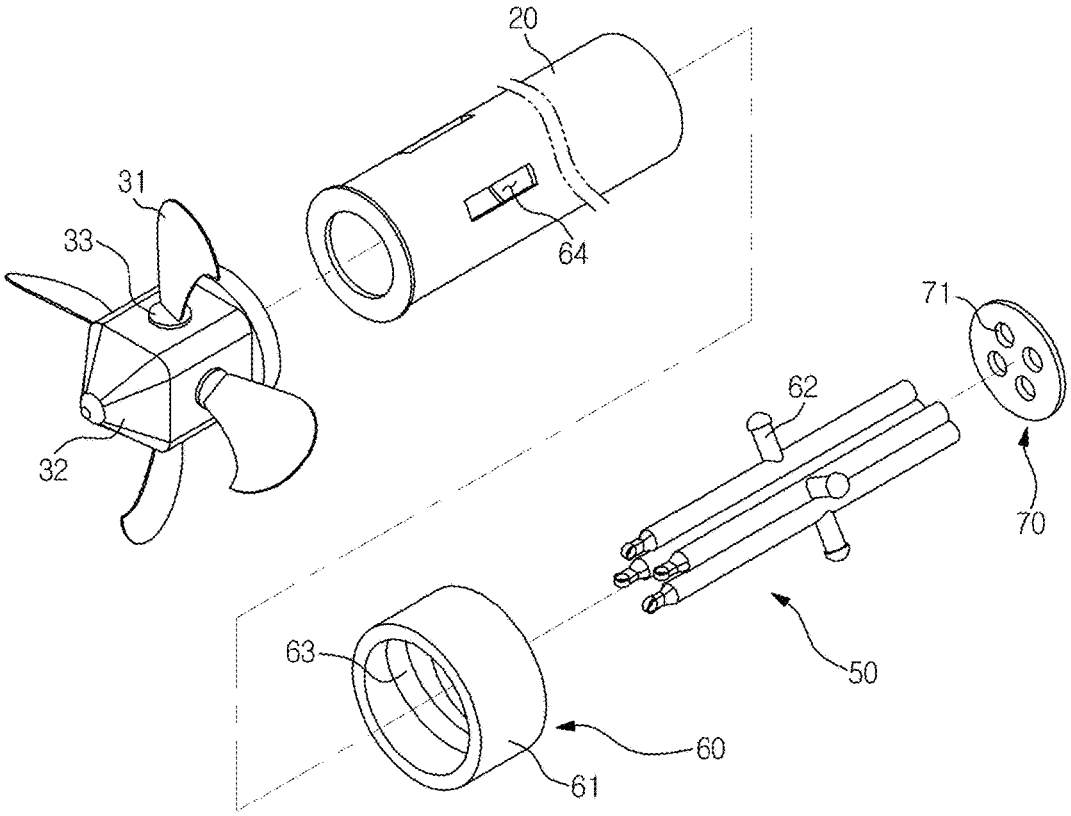
FIG. 3 is an exploded perspective view of the pitch adjuster of the embodiment of the present invention.
Figure 4:
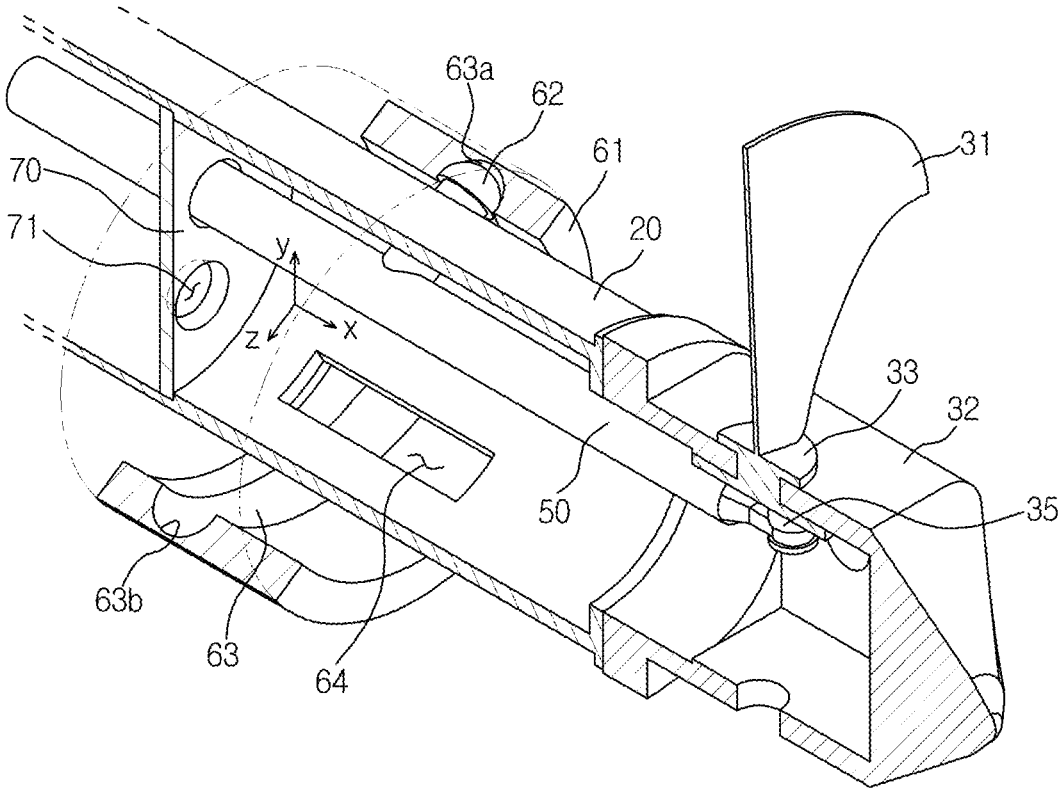
FIG. 4 illustrates an interior of a propeller shaft coupled with the pitch adjuster of the embodiment of the present invention.

FIG. 2 illustrates the variable pitch propeller coupled with the pitch adjuster of the embodiment. FIG. 3 is an exploded perspective view of the pitch adjuster of the embodiment. FIG. 4 illustrates an interior of a propeller shaft coupled with the pitch adjuster of the embodiment.

Referring to FIGS. 1 to 4, the pitch adjuster 40 includes blade actuating shafts 50 that are disposed inside the propeller shaft 20 and are installed to be able to linearly reciprocate in an axial direction of the propeller shaft 20, and a power converter 60 that converts a rotating motion of the propeller shaft 20 into a linearly reciprocating motion of the blade actuating shafts 50.

Each blade actuating shaft 50 is configured in such a manner that one end thereof is connected to the eccentric stub 35 and the other end thereof is slidably supported by a guide plate 70 fixed inside the propeller shaft 20.

The guide plate 70 is provided with through-holes 71 through which the blade actuating shafts 50 pass, and is integrally rotated along with the propeller shaft 20 with an outer circumference of the guide plate 70 supported on an inner circumferential surface of the propeller shaft 20.

Each through-hole 71 may be configured in such a manner that a diameter thereof is gradually increased (tapered) to allow a predetermined gap in a radial direction of the propeller shaft 20 when each blade actuating shaft 50 slides. This is intended to absorb a change in a radial position of the propeller shaft 20 when the blade actuating shafts 50 linearly reciprocate in an axial direction.

The power converter 60 is intended to convert the rotating motion of the propeller shaft 20 into the linear motion of the blade actuating shafts 50, and includes guide pins 62 that extend from outer circumferential surfaces of the blade actuating shafts 50 in a radially outward direction, and a guide ring 61 provided with a pitch deciding groove 63 guiding sliding movement of the guide pins 62.

The guide pins 62 may be disposed to protrude outside the propeller shaft 20 through guide slots 64 that are cut out of the outer surface of the propeller shaft 20 in an axial direction and to come into contact with the pitch deciding groove 63.

The guide ring 61 may be provided to enclose the outer circumference of the propeller shaft 20 from which the guide pins 62 protrude, and to be fixed to the stern boss 11 of the hull 10.

The guide ring 61 is provided in a hollow tube form, and the pitch deciding groove 63 is formed in an annular closed loop recessed along an inner circumferential surface of the guide ring 61.

The pitch deciding groove 63 may be disposed to have a uniaxial or biaxial inclination with respect to a yz plane orthogonal to the axial direction x of the propeller shaft 20. In other words, the pitch deciding groove 63 may be formed in an elliptical or spiral closed loop inclined at a predetermined angle with respect to the yz plane.

This pitch deciding groove 63 decides a distance at which the blade actuating shafts 50 reciprocate in the axial direction x, and controls the pitch angles of the blades 31 by pushing or pulling the eccentric stubs 35 connected to the blade actuating shafts 50 while the blade actuating shafts 50 move.

Meanwhile, a speed at which a fluid is introduced toward the variable pitch propeller 30 installed on the stern of the ship of the present embodiment is shown to be relatively faster in the lower half of the variable pitch propeller 30 than the upper half of the variable pitch propeller 300 due to the influence of a hull structure.

Figure 5:
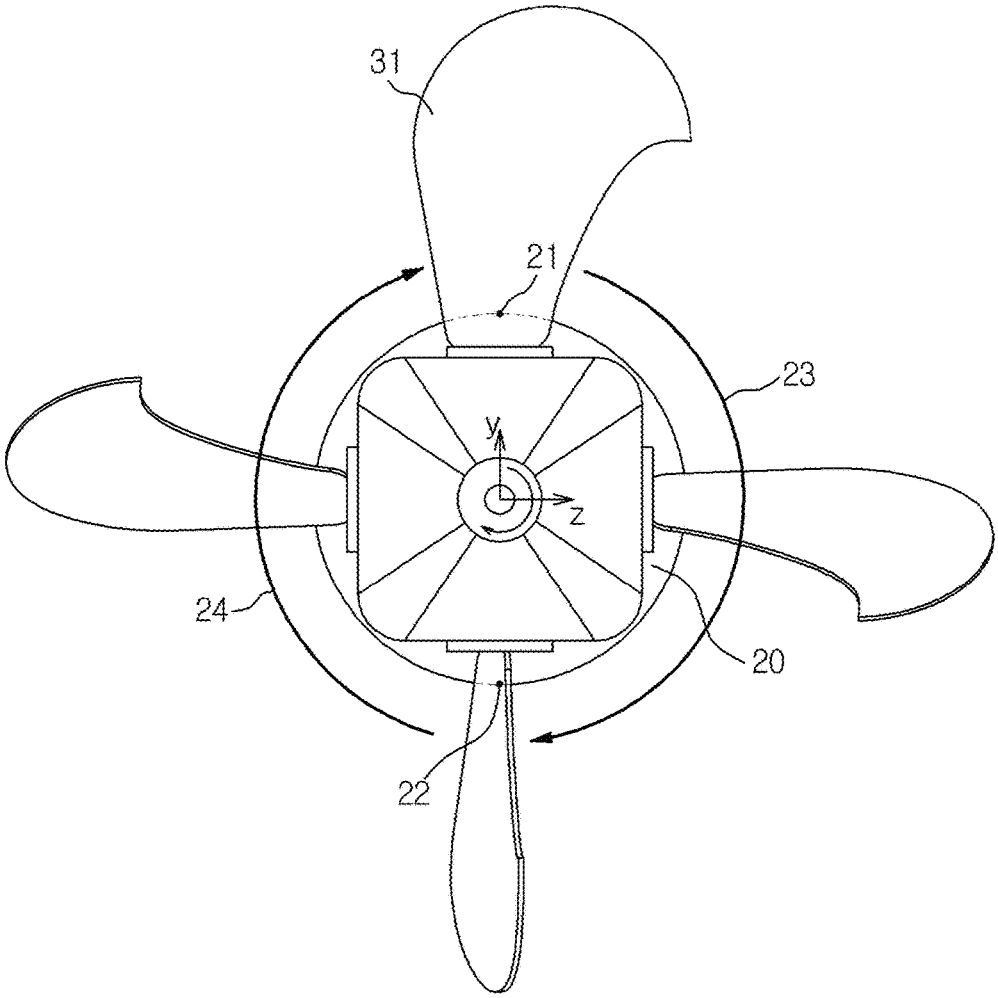
FIG. 5 illustrates a pitch angle of each blade according to a speed at which a fluid is introduced into the variable pitch propeller of the embodiment of the present invention.

In detail, as illustrated in FIG. 5, the speed at which the fluid is introduced is shown to be slowest at an uppermost end 21 of the propeller shaft 20, and to be fastest at a lowermost end 22 of the propeller shaft 20.

Based on this point, the speed at which the fluid is introduced is divided into a region 23 in which it gradually accelerates and a region 24 in which it gradually decelerates in a rotational direction of the propeller shaft 20.

Referring to FIGS. 4 and 5, in view of distribution of the speed at which the fluid is introduced, the pitch deciding groove 63 has a first position 63*a* defining a first pitch angle when the blade 31 is located at the uppermost end 21 of the propeller shaft 20, and a second position 63*b* defining a second pitch angle when the blade 31 is located at the lowermost end 22 of the propeller shaft 20, and is formed to cause movement of the blade actuating shafts 50 in a direction in which the pitch angle of the blade 31 is gradually increased in the region 23 in which the speed at which the fluid is introduced gradually accelerates in the rotational direction of the propeller shaft 20, that is, from the first position 63*a* to the second position 63*b*, and in a direction in which the pitch angle of the blade 31 is gradually decreased in the region 24 in which the speed at which the fluid is introduced fluid gradually decelerates in the rotational direction of the propeller shaft 20, that is, from the second position 63*b* to the first position 63*a*.

Figure 6:
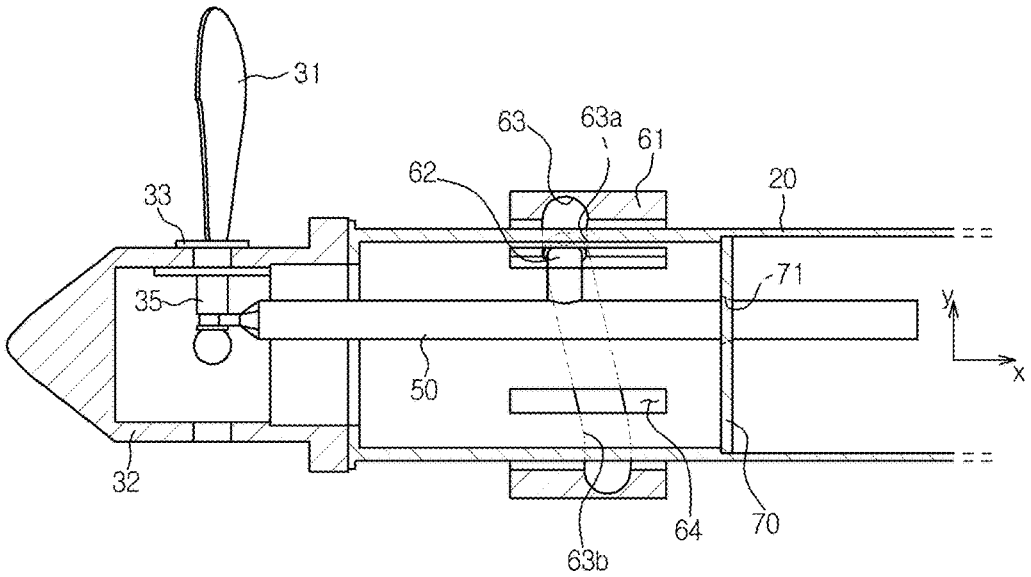
FIG. 6 illustrates an operation state in which the blade of the embodiment of the present invention is located at an uppermost end.

Hereinafter, an operation of the variable pitch propeller according to the embodiment of the present invention will be described. FIG. 6 illustrates an operation state in which the blade of the embodiment of the present invention is located at an uppermost end, and FIG. 7 illustrates an operation state in which the blade of the embodiment of the present invention is located at a lowermost end.

First, when the propeller shaft 20 is rotated, the guide pins 62 protruding outside through the guide slots 64 slide along the pitch deciding groove 63 formed in the inner circumferential surface of the guide ring 61 fixed to the stem boss 11, and cause the movement of the blade actuating shafts 50 in the axial direction x. The blade actuating shafts 50 push or pull the eccentric stubs 35 connected to lower ends of the blades 31, thereby changing the pitch angles of the blades 31.

As illustrated in FIG. 6, when the guide pin 62 is located at the first position 63*a* of the pitch deciding groove 63, the blade 31 is located at the uppermost end 21 of the propeller shaft 20, and has the minimum pitch angle. Thereafter, when the propeller shaft 20 is rotated, the guide pin 62 moves along the pitch deciding groove 63, and causes the blade actuating shafts 50 to gradually move backward. The blade actuating shafts 50 continuously pull the eccentric stubs 35, and thus gradually increase the pitch angles of the blades 31 in the rotational direction of the propeller shaft 20.

Figure 7:
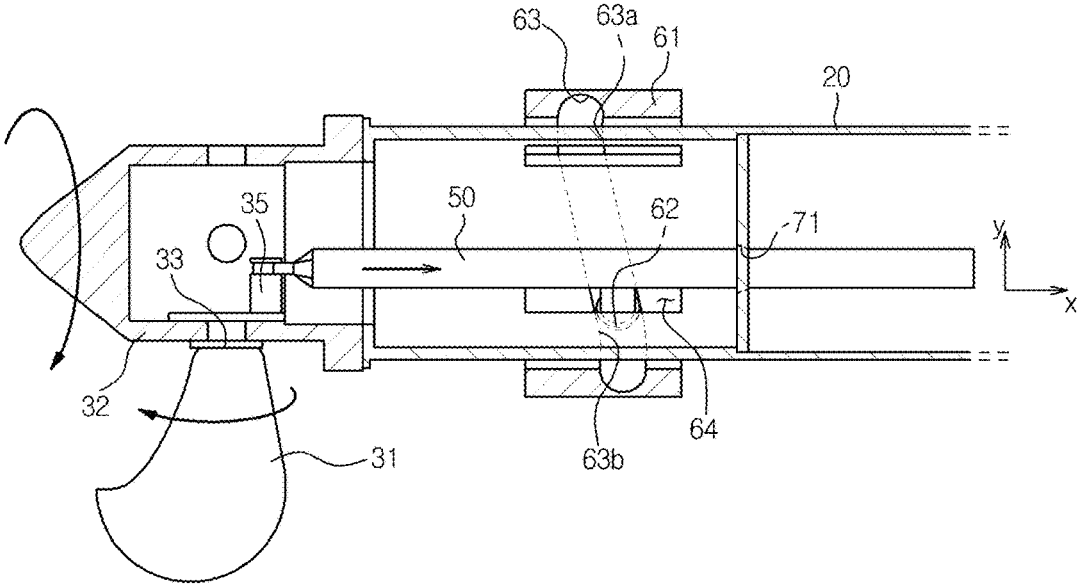
FIG. 7 illustrates an operation state in which the blade of the embodiment of the present invention is located at a lowermost end.

As illustrated in FIG. 7, when the guide pin 62 is located at the second position 63*b* of the pitch deciding groove 63, the blade 31 located at the lowermost end 63*b* of the propeller shaft 20 has the maximum pitch angle. Then, when the propeller shaft 20 is rotated, the pitch angle of the blade 31 is gradually reduced, and returns to the state of FIG. 6.

In other words, the pitch angle of each blade 31 is continuously increased or decreased according to a rotational angle of the propeller shaft 20 depending on the speed at which a fluid is introduced toward the blades 31 in the same cycle as a one-rotation cycle of the propeller shaft 20.

On the other hand, when the pitch angle of each blade is continuously changed by a hydraulic pressure, a lift force and resistance of the blade which are generated by interaction of a fluid force and torque of the blade are not steady. For this reason, the pitch angle of the blade is not constantly controlled, and the blade may be subjected to continuous irregular vibration. However, with the above configuration, the present embodiment can continuously change the pitch angle of the blade using a mechanical configuration, and thus stably change the pitch angle of the blade corresponding to the rotational angle of the propeller shaft. Further, since a separate hydraulic control system for changing the pitch angle of the blade is not required, an interior of the propeller hub and a shaft system are structurally simplified and are reduced in weight.

In addition, the optimal blade pitch angle is adjusted corresponding to the speed at which the fluid is introduced toward the propeller, and thus propulsive efficiency of the propeller is improved.

Hereinafter, a driving apparatus of a variable pitch propeller according to another embodiment of the present invention will be described. Components having the same function are given the same reference numerals or symbols, and detailed description thereof will be omitted.

Figure 8:
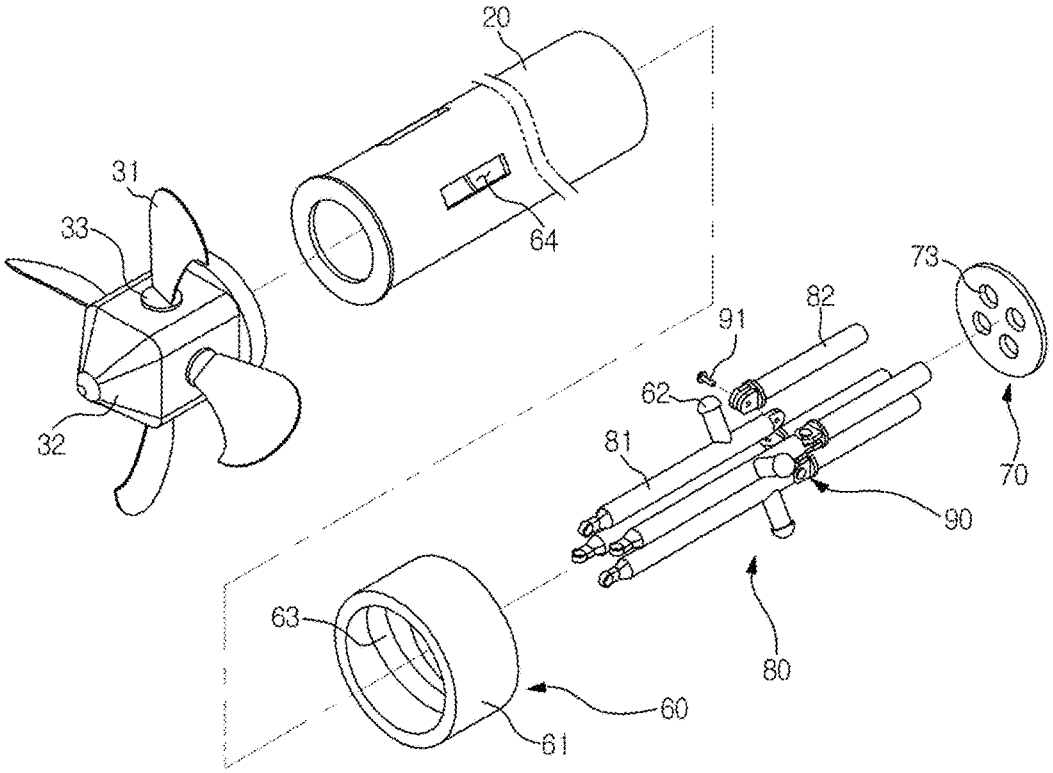
FIG. 8 is an exploded perspective view illustrating a driving apparatus of a variable pitch propeller of another embodiment of the present invention.
Figure 9:
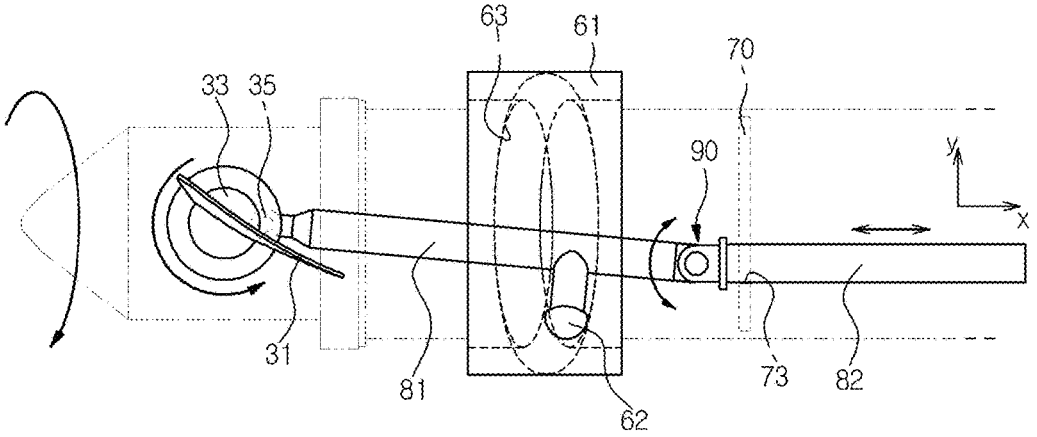
FIG. 9 illustrates an operation state of the variable pitch propeller of the other embodiment of the present invention.

FIG. 8 is an exploded perspective view illustrating a driving apparatus of a variable pitch propeller of another embodiment of the present invention. FIG. 9 illustrates an operation state of FIG. 8.

The driving apparatus of the variable pitch propeller illustrated in FIG. 8 differs only in structures of blade actuating shafts 80 connected to eccentric stubs 35, and has the same components as the above driving apparatus of the variable pitch propeller.

Each blade actuating shaft 80 includes a first portion 81 that is connected to one of the eccentric stubs 35 so as to push or pull the eccentric stub 35 and has a guide pin 62, and a second portion 82 that is inserted into a through-hole 73 of a guide plate 70 and is slidably supported. The first and second portions 81 and 82 may be rotatably coupled by a rotary joint 90.

When each blade actuating shaft 80 linearly reciprocates in an axial direction x, each rotary joint 90 absorbs a change in position of a radial direction y perpendicular to the axial direction x. Meanwhile, each rotary joint 90 of the present embodiment is formed to have a structure in which it is coupled by a hinge pin 91, which is merely one example. Any type may be applied as long as the rotary joint has a rotary structure (e.g., a ball type) so as to be able to absorb the position change of the radial direction y caused by a change in pitch of each blade 31.

Meanwhile, the through-hole 73 into which the second portion 82 is slidably inserted has a linear shape having a constant diameter so as to guide stable linear motion instead of a tapered shape.

With this structure, when each blade actuating shaft 80 linearly reciprocates in the axial direction x, as illustrated in FIG. 9, the second portion 82 of each blade actuating shaft 80 linearly moves in a stable way in the state in which it is inserted into the through-hole 73, and the first portion 81 of each blade actuating shaft 80 moves in the axial direction x and is simultaneously rotated around the rotary joint 90. Thereby, a degree of freedom of the position change of the radial direction y of the blade actuating shaft 80 depending on the pitch change of the blade 31 is secured.

The invention has been illustrated and described with respect to specific embodiments. However, the invention is not limited to the above embodiments, and thus it is apparent to those skilled in the art that various modifications, additions and substitutions are possible, without departing from the scope and spirit of the invention as disclosed in the accompanying claims.

The invention claimed is:

1. A driving apparatus of a variable pitch propeller having blades, each of which has a pitch angle changeable, and a pitch adjuster for adjusting the pitch angle, wherein the pitch adjuster includes:

blade actuating shafts that are connected to eccentric stubs coupled to lower ends of the blades and are disposed inside the propeller shaft so as to allow linear reciprocation and to push or pull the eccentric stubs; and a power converter that converts a rotating motion of the propeller shaft into a linearly reciprocating motion of the blade actuating shafts, wherein the power converter includes:

guide pins that extend from outer circumferential surfaces of the blade actuating shafts and protrude through guide slots formed in an outer surface of the propeller shaft; and a guide ring that encloses an outer circumference of the propeller shaft and has a pitch deciding groove which is formed in an inner surface thereof and along which the guide pins slide.

2. The driving apparatus according to claim 1, wherein the guide slots are cut out in an axial direction of the propeller shaft.

3. The driving apparatus according to claim 1, further comprising a guide plate which is disposed inside the propeller shaft and through which the blade actuating shafts pass to be slidably supported for stable movement of the blade actuating shafts.

4. The driving apparatus according to claim 3, wherein the guide plate includes through-holes through which the blade actuating shafts pass and each of which is in a tapered shape.

5. The driving apparatus according to claim 1, wherein:

the guide slots extend in an axial direction of the propeller shaft; and the guide pins reciprocate in the guide slots while being rotated along with the propeller shaft to slide along the pitch deciding groove.

6. The driving apparatus according to claim 1, wherein the pitch angle is changed depending on a speed at which a fluid is introduced in front of each blade.

7. The driving apparatus according to claim 6, wherein:

the propeller shaft is installed to extend through a stern boss of a hull; and the pitch angle of the blade located at an uppermost end of the propeller shaft is relatively smaller than that of the blade located at a lowermost end of the propeller shaft.

8. The driving apparatus according to claim 7, wherein the pitch angle of the blade is gradually increased from the uppermost end to the lowermost end according to a rotational angle of the propeller shaft.

9. The driving apparatus according to claim 1, wherein the blades are disposed apart along a circumference of a hub coupled to an end of the propeller shaft, and the blade actuating shafts are connected to the respective blades, individually adjust the pitch angles of the blades, and include guide pins moving along the pitch deciding groove.

10. The driving apparatus according to claim 1, wherein the pitch deciding groove is shaped of a closed loop recessed along a circumferential direction of the guide ring, and is disposed to be inclined at a predetermined angle with respect to a radial direction of the propeller shaft.

11. The driving apparatus according to claim 10, wherein:

the pitch deciding groove includes a first position defining a first pitch angle of the blade when the blade is located at an uppermost end of the propeller shaft, and a second position defining a second pitch angle of the blade when the blade is located at a lowermost end of the propeller shaft;

the first pitch angle is a minimum pitch angle; and the second pitch angle is a maximum pitch angle.

12. The driving apparatus according to claim 3, wherein each of the blade actuating shafts includes a first portion connected to each of the eccentric stubs, and a second portion supported by the guide plate, and the first and second portions are interconnected by a rotary joint.

13. A ship having the driving apparatus according to claim 1.

* * * * *